US006146182A

United States Patent [19]

Wang et al.

[11] Patent Number: 6,146,182

[45] Date of Patent: Nov. 14, 2000

[54] ELECTRICAL CONNECTOR WITH LATCHING MEANS

[75] Inventors: Wayne Wang, Alhambra, Calif.; Wei-Chung Yang, Taipei, Taiwan

[73] Assignee: Hon Hai Precision Ind. Co., Ltd., Taipei Hsien, Taiwan

[21] Appl. No.: 09/374,443

[22] Filed: Aug. 13, 1999

[51] Int. Cl.[7] ..... H01R 13/627

[52] U.S. Cl. ..... 439/357

[58] Field of Search ..... 439/350–358

[56] References Cited

U.S. PATENT DOCUMENTS

| | | | |
|---|---|---|---|
| 4,726,783 | 2/1988 | Nakazawa et al. | 439/350 |
| 5,011,424 | 4/1991 | Simmons | 439/352 |
| 5,197,901 | 3/1993 | Hashiguchi | 439/357 |
| 5,383,794 | 1/1995 | Davis et al. | 439/357 |
| 5,449,298 | 9/1995 | Fetterolf, Sr. et al. | 439/350 |
| 5,830,001 | 11/1998 | Kinoshita et al. | 439/354 |

*Primary Examiner*—Gary F. Paumen

*Attorney, Agent, or Firm*—Wei Te Chung

[57] ABSTRACT

An electrical connector for electrically coupling with an external plug, includes a housing, a plurality of contacts, and a pair of spring latching means disposed in opposite slots of the housing. Each latching means consists of a planar portion, a protrusion extruded out of the planar portion, a first support section and a second supporting section respectively bent from the planar portion along different directions, and a tab formed on a tip of the planar portion. Meanwhile, the first supporting section of each latching means is engagingly inserted within an alleyway formed on a rear wall of the corresponding slot, and the planar portion is spread with regard to the inserted first supporting section and the tab is restricted within a concave formed on a front wall of the slot to have the planar portion preloaded. And, the second supporting section abuts against a lateral wall of the slot. By way of the intensified resiliency exercised by both the first and second supporting sections, the protrusion of the latching means is capable of rapidly and sufficiently snap-fitting with a corresponding notch formed on the plug and creating a resounding audio effect easy to inspect the locking status between the mated connector and plug.

4 Claims, 6 Drawing Sheets

ELECTRICAL CONNECTOR WITH LATCHING MEANS

BACKGROUND OF THE INVENTION

1. Field of the Invention

The present invention relates to a connector for use with an electrical card, and particularity to a miniature connector for electrically coupling with an external plug connector.

2. The Prior Art

In a conventional electrical connector assembly including a plug connector and a receptacle connector, both connectors with a plurality of contacts are capable of being mutually mated thereby establishing an electrical connection or signal transmission between both connectors. And, the reliable electrical connection between the mated connectors has to rely on the sufficient retention relationship between the complementary latch means respectively formed on both connectors. However, it is extremely difficult to observe or inspect whether the retentive relationship between the complementary latch means is secure and sufficient or not, especially in a miniature type connector.

Other designs on the latch means adopt a voice or a snapping effect to inspect the retention status. Most of the audio inspections are achieved by the press-fit between the complementary latching means of the mated connectors. As the disclosure in FIG. 6 of U.S. Pat. No. 5,830,001, a plug 3 and a receptacle 5 are firmly mated by means of coupling between a notched engaging portion 33 of the plug 3 and a first protrusion 53*a* formed on each plastic engaging portion 53 of the receptacle 5. However, an overly tight fit between the mated connectors or a long-term fit easily damages the plastic engaging portion 53, i.e. a permanent deformation. Oppositely, a loose fit therebetween is hard to result in a voice or a snapping effect for inspection of the retention status. As to U.S. Pat. No. 5,830,001, the bar-like engaging portion 53 must remain in a specific thickness, otherwise either a thicker structure will result in strengthening the rigidity thereof and diminish the elasticity, relatively, or a thinner structure will result in malfunction of the voice effect of the latching means. Other similar designs on the latching means are indicated in U.S. Pat. Nos. 4,726,783, 4,838,808, 4,941,849, 5,011,424, 5,195,909, 5,234,357, 5,344,335, 5,380,223, 5,660,558, Des. 351,136, Des. 375,293, and Des, 410,896.

The invention relates a connector specialized for a miniature electrical card, i.e. a compact flash card or a PCMCIA card. Such an electrical card is adopted on memory storage or different signal transfer for a computer, a digital visual/audio recorder and player, or a network interface. The connector of the present invention is used to electrically connect a mating connector of an electrical device, like a plug, to the card device.

SUMMARY OF THE INVENTION

Accordingly, one object of the present invention is to provide an electrical connector with a latching means capable of creating a resounding audio effect easy to inspect the locking status between the electrical connector and a mating electrical connector by means of an intensified resiliency thereof.

Another object of the present invention is to provide the electrical connector with the latching means capable of rapidly and sufficiently snap-fitting with a corresponding notch formed on the mating electrical connector.

To fulfill the above mentioned objects, according to a preferred embodiment of the present invention, an electrical connector for electrically coupling with an external plug, includes an insulative housing, a plurality of contacts, and a pair of spring latching means disposed in opposite slots thereof. Each slot includes a front wall, a rear wall, and opposite lateral walls arranged around the slot. Each latching means consists of an elongated planar portion, a protrusion extruded out of the planar portion, a first support section frontward bent from the planar portion, a second supporting section rearward extended from the planar portion, and a tab formed on a tip of the planar portion. Meanwhile, the first supporting section of each latching means is engagingly abuts against an alleyway formed on the rear wall and communicated with the corresponding slot. The planar portion is spread with regard to the abutting first supporting section until the tab inversely abuts against a stopper wall formed on the front wall of the slot to have the planar portion preloaded. And, the second supporting section abuts against a lateral wall of the slot. By way of the intensified resiliency exercised by both the first and second supporting sections, the protrusion of the latching means is capable of rapidly and sufficiently snap-fitting with a corresponding notch formed on the plug and creating a resounding audio effect easy to inspect the locking status between the mated connector and plug.

DETAILED DESCRIPTION OF THE PREFERRED EMBODIMENTS

Detailed reference will now be made to the preferred embodiments of the present invention.

Figure 1:
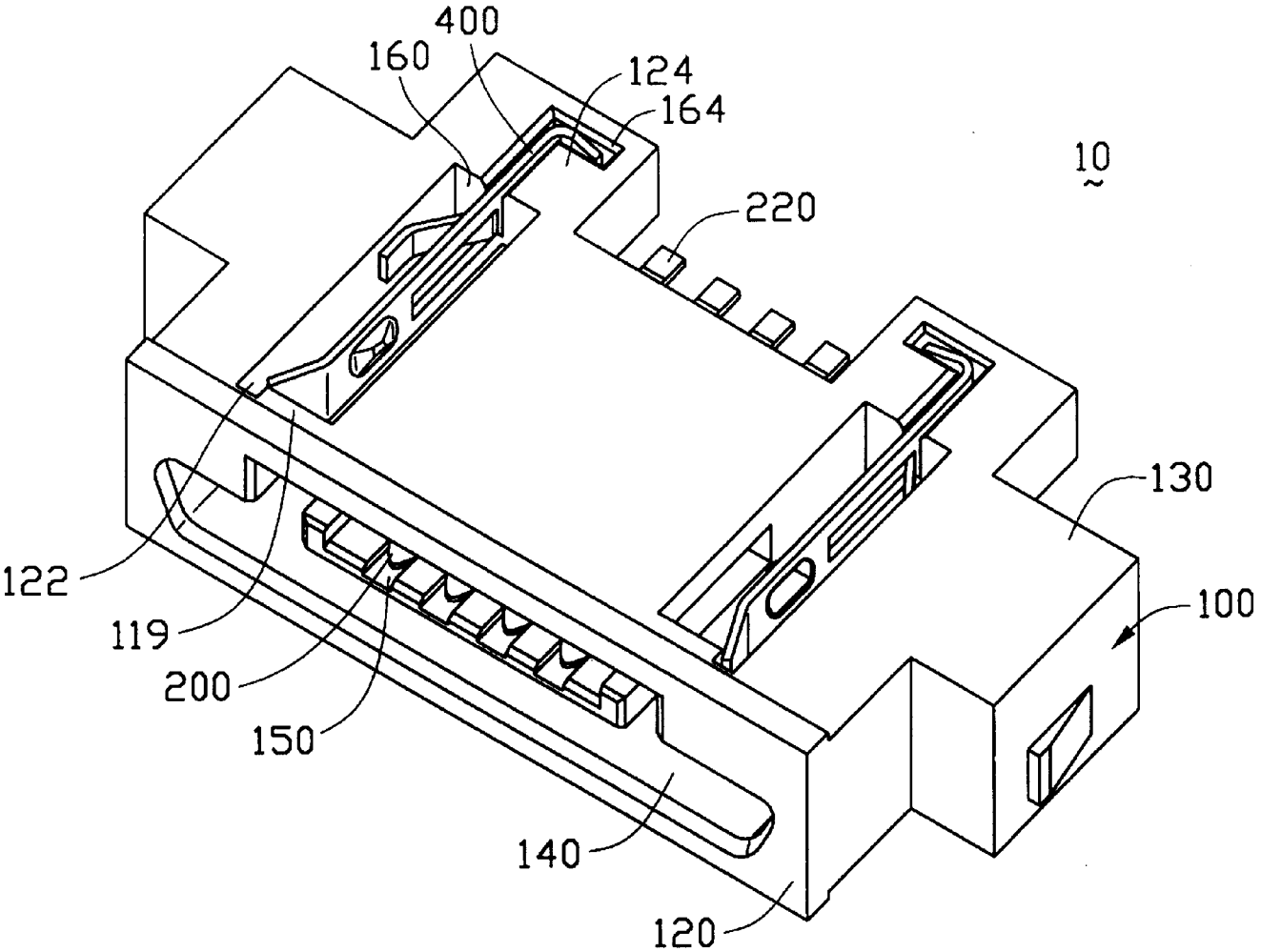
FIG. 1 is a front perspective view of an electrical connector in accordance with a preferred embodiment of the present invention.

Referring to FIG. 1, an electrical connector 10 secured to an electrical card (not shown) for coupling an external plug (not shown), consists of an insulative housing 100 and a plurality of contacts 200. A metallic shield (not shown) is selectively disposed around the housing 100. The housing 100 defines a plurality of recesses 150 in a row for reception of the contacts 200 therein, and a cavity 140 through a front surface 120 of the housing to form an opening for permitting the insertion of the external plug therein.

Figure 3:
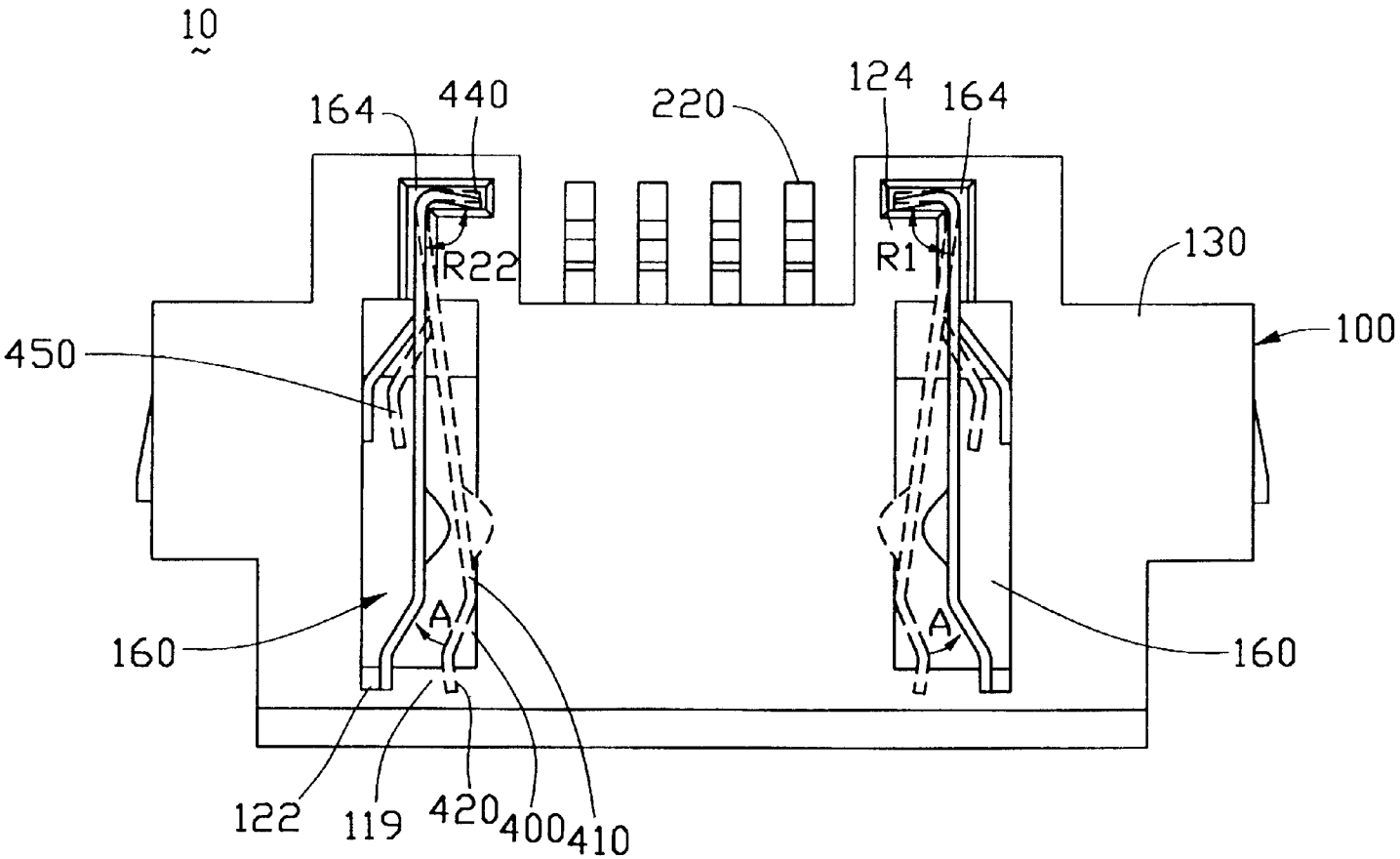
FIG. 3 is a top view of the electrical connector shown in FIG. 1 showing that the spring latching means is being disposed inside the connector.

Further referring to FIGS. 1 & 3, each contact 200 has a soldering tail 220 extending through the cavity 140 of the housing 100 for soldering to a circuit board of the electrical card (not shown). A pair of separated slots 160 are defined through a top wall 130 of the housing at opposite lateral sides thereof and communicated with the cavity 140. Each slot 160 includes a front wall, a rear wall, and a pair of opposite lateral walls arranged around the slot 160. An L-shaped alleyway 164 is defined inside the rear wall of the each slot 160 and perpendicularly communicates with the slot 160. A cornered wall 124 with an angle R1 is located inside the alleyway 164. A concave 122 and a stopper wall 119 next to the concave 122 are formed on the front wall of each slot 160. A pair of spring latching means 400 are disposed inside the slots 160 for locking with the external plug.

Figure 2:
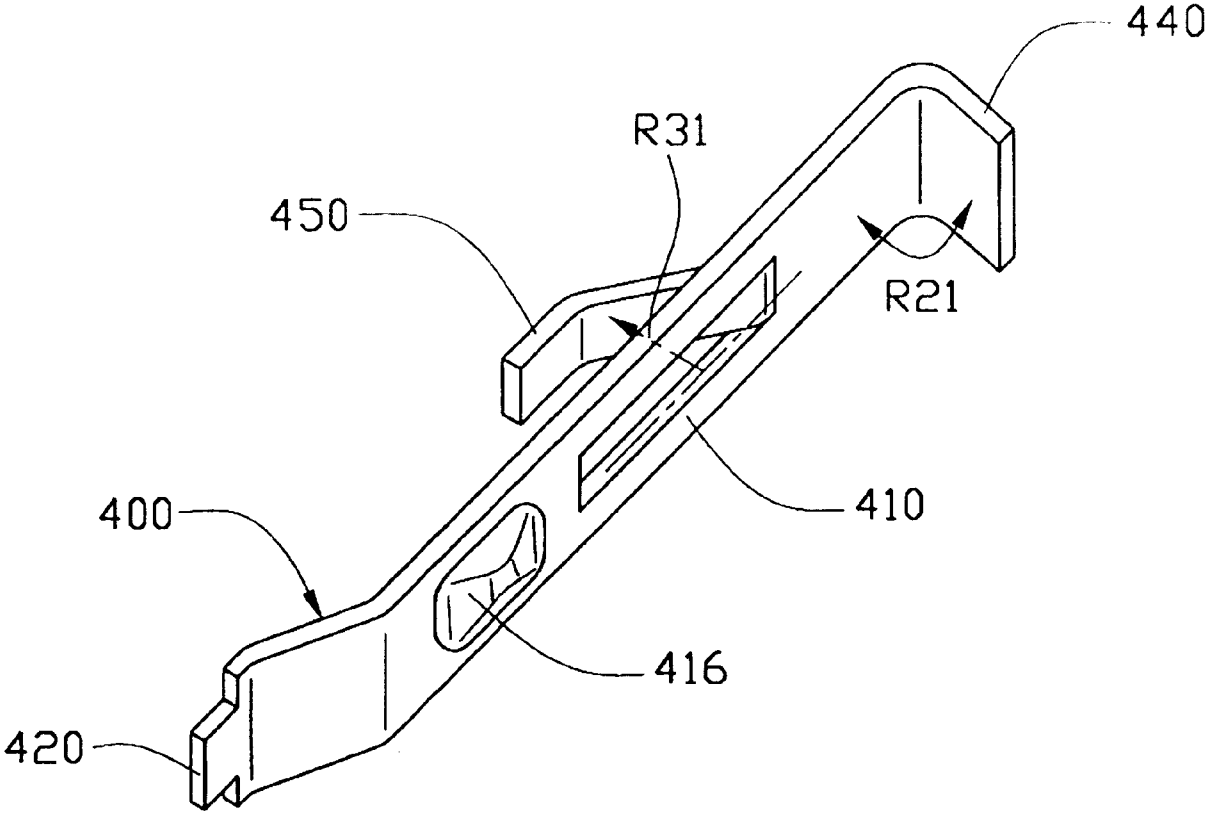
FIG. 2 is an enlarged front perspective view of a spring latching means for use with the electrical connector shown in FIG. 1.

Each spring latching means 400 as shown in FIG. 2, consist of an elongated planar portion 410, a protrusion 416 extruded out of the planar portion 410 as a dimple, a first support section 440 integrally and forward bent from the planar portion 410 at a angle R21, a second supporting section 450 integrally and rearward extended from the planar portion 410 at a angle R31, and a tab 420 formed adjacent to a tip of the planar portion 410.

Figure 4:
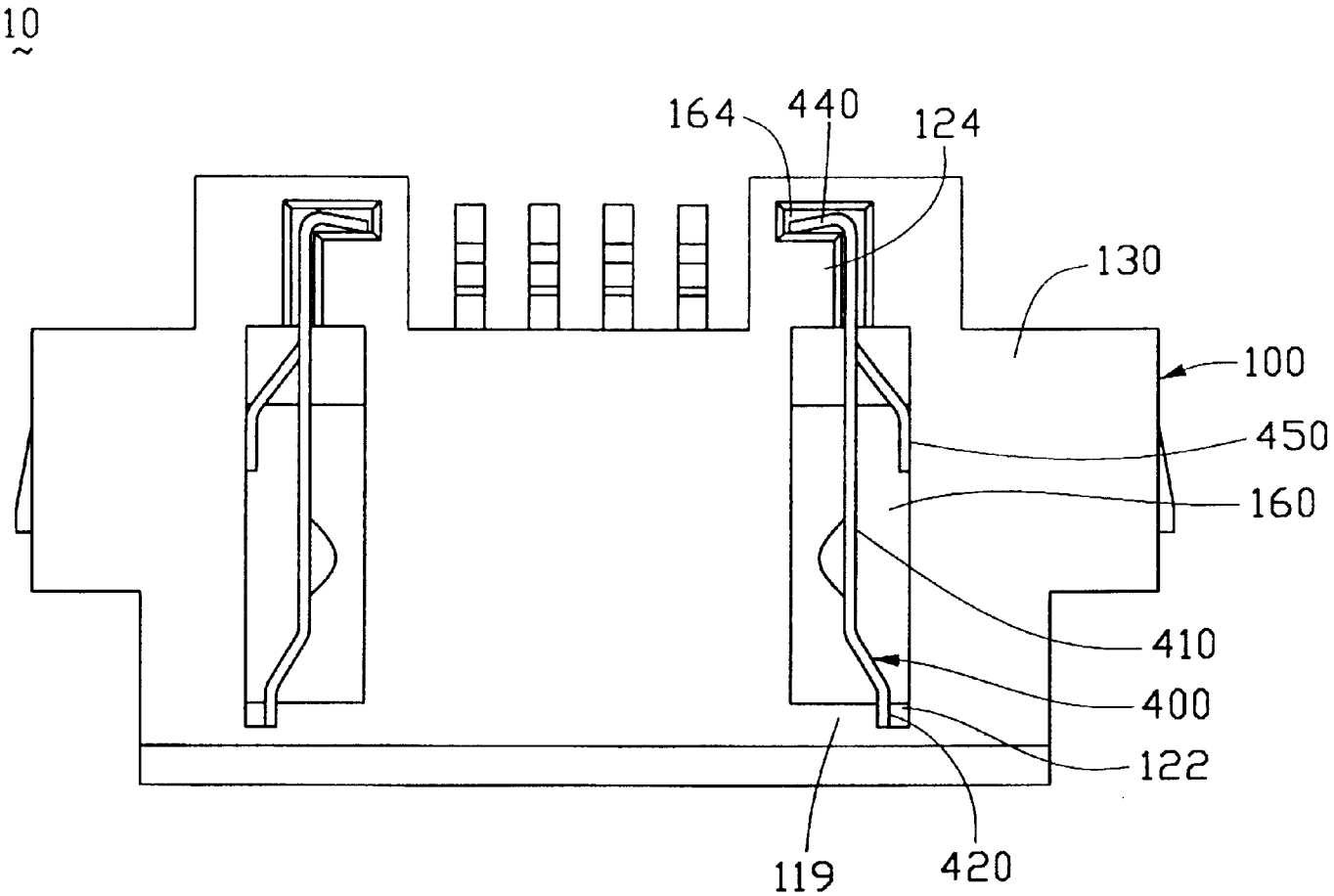
FIG. 4 is another top view of the electrical connector shown in FIG. 1.

In assembly as shown in FIG. 3, each spring latching means 400 is being disposed inside the corresponding slot 160 of the housing 100 from the top wall 130. Firstly, the first supporting section 440 of each latching spring 400 is movably located inside the corresponding alleyway 164, and the planar portion 410 is located above the top wall 130 of the housing 100 at a first position next to the innermost lateral wall of the corresponding slot 160. As soon as the angle R1 of the corresponding cornered wall 124 is designated to more than the angle R21 of the first supporting section 440, the planar portion 410 of the latching means 400 is directly deflected along a direction A, at an angle R22 more than the initial angle R21, by means that the first supporting section 440 pressingly abuts against the cornered wall 124 of the corresponding alleyway 164. And, the tab 420 fell on and then movably restricted within the corresponding concave 122 of the housing 122 from the recovery of the planar portion 410 by means of inversely abutting against the corresponding stopper wall 119. Therefore, the planar portion 410 can be preloaded because of the spread resiliency thereof. However, it is alternative selection that as soon as the angle R1 of the corresponding cornered wall 124 is designated to be equal to or less than the angle R21 of the first supporting section 440, the entire latching means 400 is further outwardly rotated along the direction A until the first supporting section 440 pressingly abuts against the cornered wall 124 of the corresponding alleyway 164. Then, the planar portion 410 of the latching means 400 is outwardly and elastically deflected with regard to the abutting first supporting section 440 at the angle R22. Beside, the second supporting section 450 confronts with the outermost lateral wall of the corresponding slot 160. The result is indicated in FIG. 4.

Figure 5:
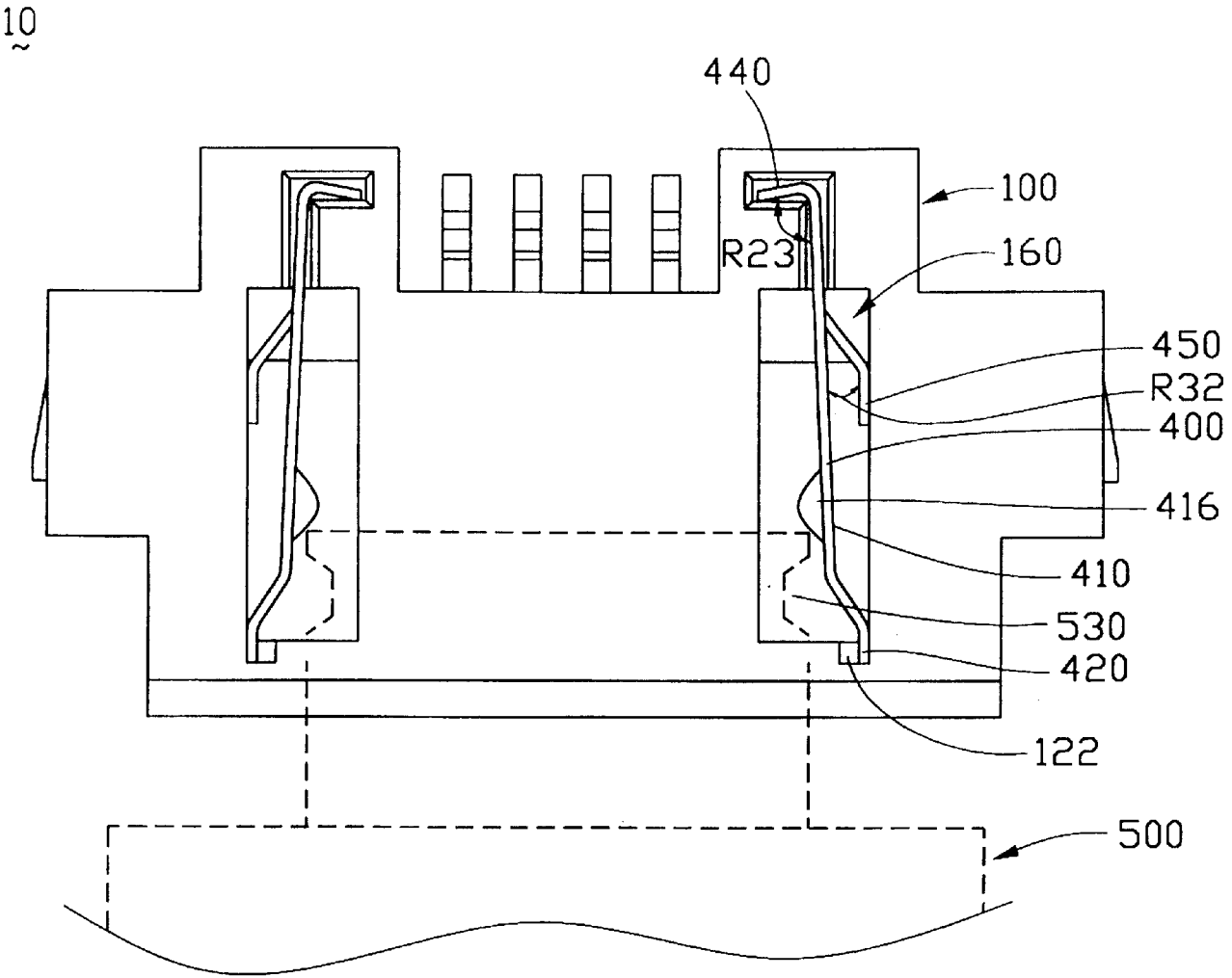
FIGS. 5–6 are successive schemata of the electrical connector of FIG. 1 showing the inserting process of an external plug into the connector.
Figure 6:
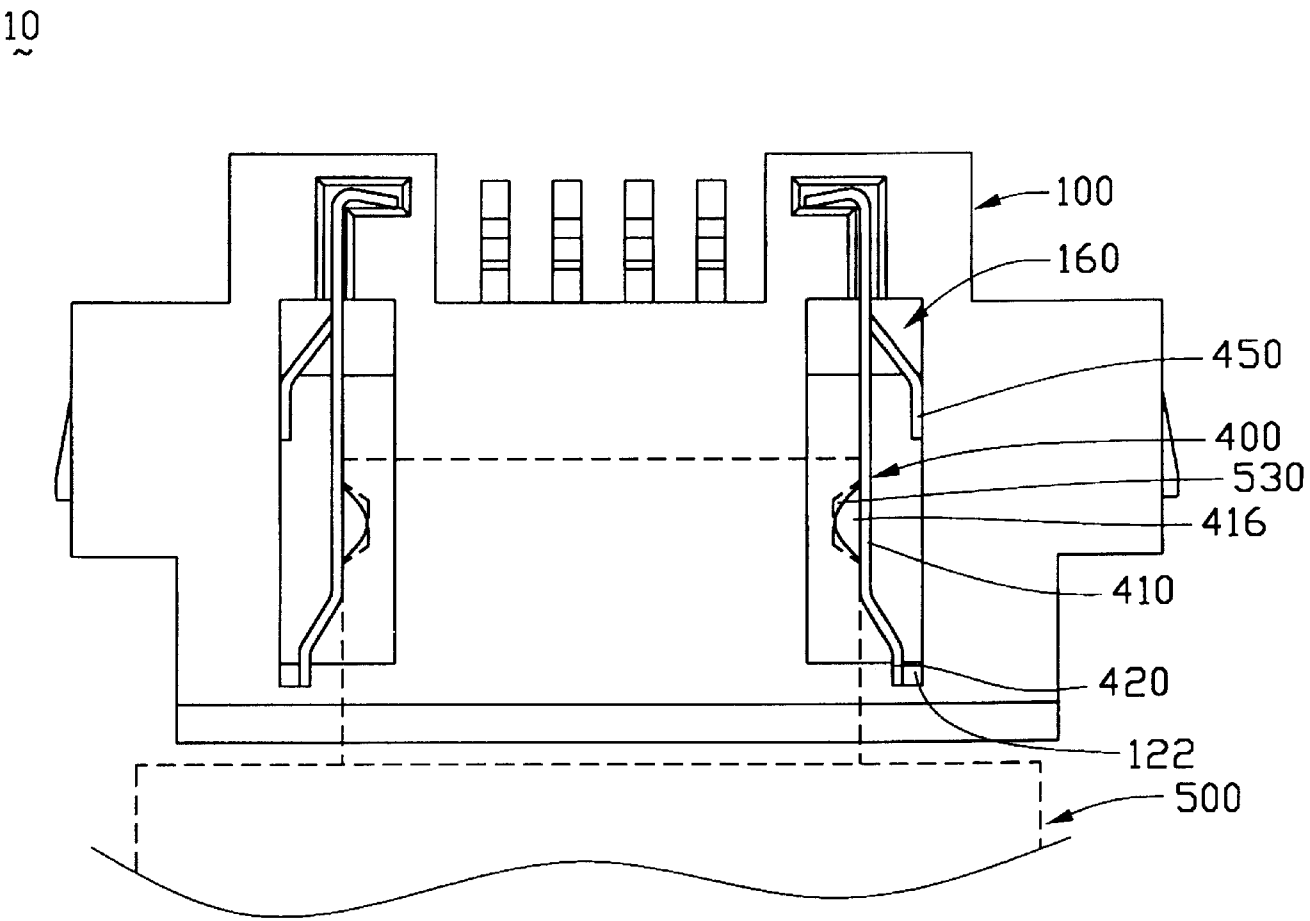

In FIGS. 5 & 6, a simple schema in dotted lines is illustrated to represent the external plug for understanding. In an initial stage as shown in FIG. 5, the protrusion 416 of each spring latching means 400 is outwardly impressed by a mating end of the external plug 500 so that the planar portion 410 is outwardly and progressively deflected with regard to the abutting first supporting section 440 at an angle R23 more than the angle R22. At the same time, the second supporting section 450 abutting against the outermost lateral wall of the corresponding slot 160 is relatively compressed at an angle R32 less than the initial angle R31. The tab 420 restricted within the corresponding concave 122 is also outward moved to pressingly abut against the outermost lateral wall of the corresponding slot 160. The planar portion 410 can be therefore avoided from over deforming in support of both the tab 420 and the second supporting section 450.

As long as the external plug 500 is continuously inserted to have the protrusion 416 of the latching means 400 fitted with a corresponding notch 530 formed on the plug 500 as shown in FIG. 6, the planar portion 410 is rapidly and sufficient recovered because of the enhanced resiliency exercised by the preloaded planar portion 410, the compressed tab 420 and the compressed second supporting section 450. Hence, the protrusion 416 of the spring latching means 400 can suddenly impacts/snap with the notch 530 of the plug 500 to create a resounding audio effect. The resounding audio effect is capable of efficiently inspecting the locking status between the electrical connector 10 and the plug 500.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector for mating with an external mating connector, comprising:

an insulative housing defining at least an elongated slot which forms a first, second and third walls located at different directions;

a plurality of contacts received within the housing for electrical engagement with the mating connector, each having a soldering tail at a distal end thereof; and a spring latching means disposed inside the housing, including at least an elongated planar portion extending inside the slot, a protrusion extruded out of the planar portion, a first supporting section extended from the planar portion at a first angle and inserted inside the first wall of the housing, and a second supporting section integrally extended from the planar portion at a second angle to confront the second wall of the housing, wherein as soon as the mating connector is inserted into the housing to outwardly and elastically deflect the planar portion with regard to the first supporting section and to compress the second supporting section, the first angle is progressively increased but the second angle is progressively reduced until the protrusion of the spring latching means is snap-fitted with a corresponding notch formed on the mating connector and the planar portion rapidly and sufficiently recovers due to the intensified resiliency exercised by both of the first and second supporting sections.

2. The electrical connector as defined in claim 1, wherein the first supporting section of the latching means extends into an alleyway defined on the first wall of the housing and perpendicularly communicating with the slot.

3. The electrical connector as defined in claim 1, wherein a tab is formed adjacent to a tip of the planar portion and movably restricted within a concavity defined in the third wall of the housing.

4. The electrical connector as defined in claim 3, wherein the planar portion of the latching means is preloaded by the tab pressingly abutting against an inner wall of the concavity.

* * * * *